US011174525B2

(12) United States Patent
Han et al.

(10) Patent No.: US 11,174,525 B2
(45) **Date of Patent: *Nov. 16, 2021**

(54) ANNEALING SEPARATOR COMPOSITION FOR ORIENTED ELECTRICAL STEEL SHEET, ORIENTED ELECTRICAL STEEL SHEET, AND METHOD FOR MANUFACTURING ORIENTED ELECTRICAL STEEL SHEET

(71) Applicant: POSCO, Pohang-si (KR)

(72) Inventors: Min Soo Han, Pohang-si (KR); Jong-Tae Park, Pohang-si (KR); Yun Su Kim, Pohang-si (KR); Chang Soo Park, Pohang-si (KR)

(73) Assignee: POSCO, Pohang-si (KR)

( * ) Notice: Subject to any disclaimer, the term of this patent is extended or adjusted under 35 U.S.C. 154(b) by 51 days.

This patent is subject to a terminal disclaimer.

(21) Appl. No.: 16/471,868

(22) PCT Filed: Dec. 20, 2017

(86) PCT No.: PCT/KR2017/015124

§ 371 (c)(1),
(2) Date: Jun. 20, 2019

(87) PCT Pub. No.: WO2018/117638

PCT Pub. Date: Jun. 28, 2018

(65) Prior Publication Data

US 2019/0382860 A1 Dec. 19, 2019

(30) Foreign Application Priority Data

Dec. 21, 2016 (KR) ..... 10-2016-0176060

(51) Int. Cl.

| | |
|---|---|
| ***C21D 3/04*** | (2006.01) |
| ***C21D 8/12*** | (2006.01) |
| ***C21D 9/46*** | (2006.01) |
| ***C22C 38/02*** | (2006.01) v |

(Continued)

(52) U.S. Cl.
CPC ..... *C21D 3/04* (2013.01); *C21D 8/1222* (2013.01); *C21D 8/1233* (2013.01);
(Continued)

(58) Field of Classification Search
CPC ..... C21D 1/76; C21D 3/04; C21D 8/1222; C21D 8/1233; C21D 8/125; C21D 8/1255;
(Continued)

(56) References Cited

U.S. PATENT DOCUMENTS 4,287,006 A * 9/1981 Hiromae ..... C23D 5/10 148/113
5,565,272 A * 10/1996 Masui ..... C21D 8/1283 428/432
5,863,356 A 1/1999 Bolling et al.

FOREIGN PATENT DOCUMENTS

BE 880287 A 3/1980
GA 984106 A 2/1976
(Continued)

OTHER PUBLICATIONS

Extended European Search Report dated Sep. 9, 2019 issued in European Patent Application No. 17882317.5.
(Continued)

*Primary Examiner* — Jenny R Wu
(74) *Attorney, Agent, or Firm* — Morgan, Lewis & Bockius LLP

(57) ABSTRACT

The present invention has been made in an effort to provide an annealing separator component for an oriented electrical steel sheet, an oriented electrical steel sheet, and a manufacturing method thereof. According to an exemplary embodiment of the present invention, an annealing separator composition for an oriented electrical steel sheet, includes: 100 weight parts of at least one of magnesium oxide and
(Continued)

magnesium hydroxide; and 5 to 200 weight parts of aluminum hydroxide.

7 Claims, 10 Drawing Sheets

(51) Int. Cl.

| | |
|---|---|
| ***C22C 38/00*** | (2006.01) |
| ***C22C 38/04*** | (2006.01) |
| ***C22C 38/06*** | (2006.01) |
| ***C22C 38/60*** | (2006.01) |
| ***H01F 1/18*** | (2006.01) |

(52) U.S. Cl.
CPC ..... *C21D 8/1272* (2013.01); *C21D 8/1283* (2013.01); *C21D 9/46* (2013.01); *C22C 38/004* (2013.01); *C22C 38/02* (2013.01); *C22C 38/04* (2013.01); *C22C 38/06* (2013.01); *C22C 38/60* (2013.01); *C22C 2202/02* (2013.01); *C22C 2204/00* (2013.01)

(58) Field of Classification Search
CPC .. C21D 8/1261; C21D 8/1272; C21D 8/1283; C21D 8/1288; C21D 9/46; C22C 2202/02; C22C 2204/00; C22C 38/00; C22C 38/004; C22C 38/02; C22C 38/04; C22C 38/06; C22C 38/60; C23C 28/321; C23C 28/322; C23C 28/345; C23C 8/02; C23C 8/10; C23C 8/14; C23C 8/26; C23C 8/80; H01F 1/18
See application file for complete search history.

(56) References Cited

FOREIGN PATENT DOCUMENTS

| | | | | |
|---|---|---|---|---|
| GN | 104726796 | A | | 6/2015 |
| GN | 104884646 | A | | 9/2015 |
| JP | S55-73823 | A | | 6/1980 |
| JP | S55-138021 | A | | 10/1980 |
| JP | H07-173642 | A | | 7/1995 |
| JP | H07-278827 | A | | 10/1995 |
| JP | H08-165521 | A | | 6/1996 |
| JP | 2698549 | B2 | | 1/1998 |
| JP | 2003253334 | A | * | 9/2003 |
| JP | 3524058 | B2 | | 4/2004 |
| JP | 4569281 | B2 | | 10/2010 |
| JP | 2014-201806 | A | | 10/2014 |
| JP | 2016-060953 | A | | 4/2016 |
| JP | 2016-69563 | A | | 5/2016 |
| JP | 2016-513358 | A | | 5/2016 |
| KR | 10-2006-0013178 | A | | 2/2006 |
| KR | 10-2006-0074659 | A | | 7/2006 |
| KR | 10-2006-0074664 | A | | 7/2006 |
| KR | 10-2007-0067846 | A | | 6/2007 |
| KR | 10-0762436 | B1 | | 10/2007 |
| KR | 10-1089303 | B1 | | 12/2011 |
| KR | 10-2013-0076644 | A | | 7/2013 |
| KR | 10-2016-0057754 | A | | 5/2016 |
| KR | 10-2016-0063244 | A | | 6/2016 |
| KR | 10-1651431 | B1 | | 8/2016 |
| WO | 2006/126660 | A1 | | 11/2006 |

OTHER PUBLICATIONS

International Search Report issued in International Application No. PCT/KR2017/015124 dated Apr. 30, 2018, with English translation.
European Office Action dated Jun. 5, 2020 issued in European Patent Application No. 17882317.5.
Chinese Search Report dated May 26, 2020 issued in Chinese Patent Application No. 201780079997.6.
Japanese Office Action dated Apr. 6, 2021 issued in Japanese Patent Application No. 2019-533582.

* cited by examiner

ANNEALING SEPARATOR COMPOSITION FOR ORIENTED ELECTRICAL STEEL SHEET, ORIENTED ELECTRICAL STEEL SHEET, AND METHOD FOR MANUFACTURING ORIENTED ELECTRICAL STEEL SHEET

CROSS REFERENCE

This application is the U.S. National Phase under 35 U.S.C. § 371 of International Application No. PCT/KR2017/015124 filed on Dec. 20, 2017, which claims the benefit of Korean Application No. 10-2016-0176060 filed on Dec. 21, 2016, the entire contents of each are hereby incorporated by reference.

TECHNICAL FIELD

This relates to an annealing separator component for an oriented electrical steel sheet, an oriented electrical steel sheet, and a manufacturing method thereof.

BACKGROUND ART

An oriented electrical steel sheet refers to an electrical steel sheet containing a Si component in a steel sheet, having a structure of a crystalline orientation aligned in the {110}<001> direction, and having excellent magnetic properties in the rolling direction.

Recently, as oriented electrical steel sheets with a high magnetic flux density have been commercialized, a material having low iron loss has been required. In the case of electrical steel sheet, the iron loss improvement may be approached by four technical methods. Firstly, there is a method of orienting the {110}<001> crystalline orientation including the easy axis of the oriented electrical steel sheet precisely to the rolling direction, secondly, thinning of the material, thirdly, a magnetic domain refinement method which refines the magnetic domain through chemical and physical methods, and lastly, improvement of surface physical properties or surface tension by a chemical method such as surface treatment and coating.

Particularly, with respect to the improvement of the surface physical property or surface tension, a method of forming a primary coating and an insulation coating has been proposed. As a primary coating, a forsterite ($2MgO.SiO_2$) layer consisting of a reaction of silicon oxide ($SiO_2$) produced on the surface of the material in a primary recrystallization annealing process of the electric steel sheet material and magnesium oxide (MgO) used as an annealing separator is known. The primary coating formed during the high temperature annealing must have a uniform hue without defects in appearance, and functionally prevents fusion between the plates in the coil state, and may have the effect of improving the iron loss of the material by giving a tensile strength to the material due to the difference in thermal expansion coefficient between the material and the primary coating.

Recently, as the demand for low iron loss oriented electrical steel sheets has increased, high tension of the primary coating has been sought, and in order to greatly improve the magnetic properties of the final products, the control technique of various process factors has been attempted in order to improve the properties of the high tension insulation coating. Typically, the tension which is applied to the material by the primary coating, the secondary insulation, or tension coating is generally greater than 1.0 kgf/mm$^2$, and in this case, a tension ratio of each is approximately 50/50. Therefore, the coating tension by forsterite is about 0.5 kgf/mm$^2$, and if the coating tension by the primary coating is improved compared to the present, the transformer efficiency may be improved as well as the iron loss.

In this regard, a method of introducing a halogen compound into the annealing separator to obtain a coating having the high tension has been proposed. Further, a technique of forming a mullite coating having a low thermal expansion coefficient by applying an annealing separator, in which the main component is kaolinite, has been proposed. In addition, methods for enhancing the interfacial adhesion by introducing rare earth elements such as Ce, La, Pr, Nd, Sc, and Y have been proposed. However, the annealing separator additive suggested by these methods is very expensive and has a problem that the workability is considerably lowered for being applied to the actual production process. Particularly, materials such as kaolinite are insufficient in their role as an annealing separator because of their poor coating property when they are manufactured from a slurry for use as the annealing separator.

DISCLOSURE

The present invention has been made in an effort to provide an annealing separator component for an oriented electrical steel sheet, an oriented electrical steel sheet, and a manufacturing method thereof. Specifically, the present invention provides an annealing separator composition for an oriented electrical steel sheet, an oriented electrical steel sheet, and a method for manufacturing thereof, which is excellent in adhesion and coating tension so that it improves iron loss of a material.

An exemplary embodiment of the present invention provides an annealing separator composition for an oriented electrical steel sheet, including: 100 weight parts of at least one of a magnesium oxide and a magnesium hydroxide; and 5 to 200 weight parts of aluminum hydroxide.

The aluminum hydroxide may have an average particle size of 5 to 100 pm. 1 to 10 weight parts of ceramic powder may be further included.

The ceramic powder may be at least one selected from $Al_2O_3$, $SiO_2$, $TiO_2$, and $ZrO_2$.

50 to 500 weight parts of a solvent may be further included.

In the oriented electrical steel sheet according to the exemplary embodiment of the present invention, a coating including an Al—Si—Mg composite is formed on one or opposite sides of a substrate of an oriented electrical steel sheet.

The coating may contain 0.1 to 40 wt % of Al, 40 to 85 wt % of Mg, 0.1 to 40 wt % of Si, 10 to 55 wt % of 0, and Fe as a balance.

The coating may further include a Mg—Si composite, an Al—Mg composite, or an Al—Si composite.

The coating may have a thickness of 0.1 to 10 μm.

An oxide layer may be formed from an interface between the coating and the substrate to an interior of the substrate.

The oxide layer may contain an aluminum oxide.

An average particle diameter of the aluminum oxide may be 5 to 100 μm with respect to a cross-section in a thickness direction of the steel sheet.

The occupying area of the aluminum oxide relative to an area of the oxide layer may be 0.1 to 50%, with respect to the cross-section in the thickness direction of the steel sheet.

The substrate of the oriented electrical steel sheet may contain 2.0 to 7.0 wt % of silicon (Si), 0.020 to 0.040 wt % of aluminum (Al), 0.01 to 0.20 wt % of manganese (Mn), 0.01 to 0.15 wt % of phosphorus (P), 0.01 wt % or less (excluding 0 wt %) of carbon (C), 0.005 to 0.05 wt % of nitrogen (N), and 0.01 to 0.15 wt % of antimony (Sb), tin (Sn), or a combination thereof, and the balance contains Fe and other inevitable impurities.

According to an exemplary embodiment of the present invention, a manufacturing method of an oriented electrical steel sheet includes: preparing a steel slab; heating the steel slab; forming a hot-rolled sheet by hot-rolling the heated steel slab; forming a cold-rolled sheet by cold-rolling the hot-rolled sheet; performing first recrystallization annealing on the cold-rolled sheet; applying an annealing separator on a surface of the steel sheet that has been subjected to the first recrystallization annealing; and performing second recrystallization annealing on the steel sheet on which the annealing separator is applied.

The annealing separator may contain 100 weight parts of at least one of magnesium oxide and magnesium hydroxide, and 5 to 200 weight parts of aluminum hydroxide.

The performing of the first recrystallization annealing on the cold-rolled sheet may include simultaneously performing decarburizing annealing and nitriding annealing on the cold-rolled sheet, or performing the nitriding annealing after the decarburizing annealing.

According to the exemplary embodiment of the present invention, it is possible to provide an oriented electrical steel sheet having excellent iron loss and flux density and excellent adhesion and insulation property of a coating, and a manufacturing method thereof.

MODE FOR INVENTION

Figure 1:
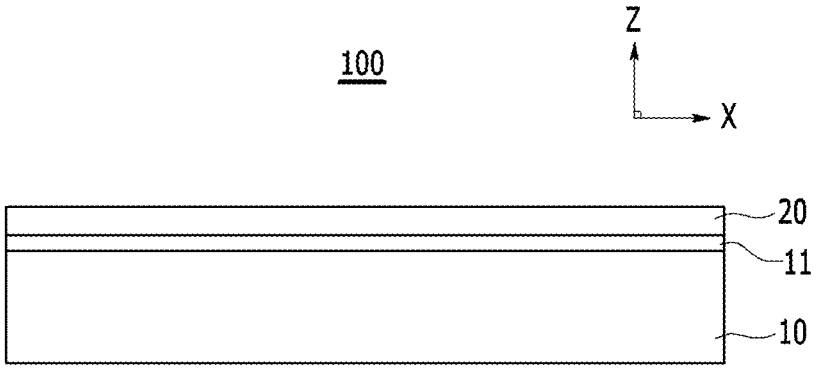
FIG. 1 illustrates a schematic side cross-sectional view of an oriented electrical steel sheet according to an exemplary embodiment of the present invention.

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first component, constituent element, or section described below may be referred to as a second component, constituent element, or section, without departing from the range of the present invention.

The terminologies used herein are just used to illustrate a specific exemplary embodiment, but are not intended to limit the present invention. It must be noted that, as used in the specification and the appended claims, singular forms used herein include plural forms unless the context clearly dictates the contrary. It will be further understood that the term "comprises" or "includes", used in this specification, specifies stated properties, regions, integers, steps, operations, elements, and/or components, but does not preclude the presence or addition of other properties, regions, integers, steps, operations, elements, components, and/or groups.

When referring to a part as being "on" or "above" another part, it may be positioned directly on or above the other part, or another part may be interposed therebetween. In contrast, when referring to a part being "directly above" another part, no other part is interposed therebetween.

In the present invention, 1 ppm indicates 0.0001%.

In an exemplary embodiment of the present invention, the meaning of further comprising/including an additional component implies replacing a balance by an additional amount of the additional component.

Unless defined otherwise, all terms including technical and scientific terms used herein have the same meaning as commonly understood by one of ordinary skill in the art to which the present invention belongs. Terms defined in commonly used dictionaries are further interpreted as having meanings consistent with the relevant technical literature and the present disclosure, and are not to be construed as idealized or very formal meanings unless defined otherwise.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

According to an exemplary embodiment of the present invention, an annealing separator composition for an oriented electrical steel sheet, includes: 100 weight parts of at least one of a magnesium oxide (MgO) and a magnesium hydroxide ($Mg(OH)_2$); and 5 to 200 weight parts of aluminum hydroxide $(AlOH)_3$. The weight parts herein indicates a weight contained relative to each component.

An annealing separator composition for an oriented electrical steel sheet according to an embodiment of the present invention is prepared, some of which reacts with silica formed on the surface of a substrate to form a composite of Al—Si—Mg by adding aluminum hydroxide ($Al(OH)_3$), which is a reactive substance, in addition to magnesium oxide (MgO), which is one of the components of the conventional annealing separator composition, and there is an effect of improving the tension by coating by diffusing some of which into an oxide layer in the substrate to improve the adhesion of the coating. Further, this effect ultimately plays a role of reducing the iron loss of the material such that a high efficiency transformer with low power dissipation may be manufactured.

When the cold rolled sheet passes through a heating furnace controlled in a moist atmosphere for the primary recrystallization in the manufacturing process of the oriented electrical steel sheet, Si having the highest oxygen affinity in the steel reacts with oxygen supplied from the steam in the furnace to form SiO2 on the surface. Thereafter, oxygen penetrates into the steel to produce an Fe-based oxide. The SiO2 thus formed forms a forsterite (Mg2SiO4) layer through a chemical reaction with magnesium oxide or magnesium hydroxide in the annealing separator as shown in the following Reaction Scheme 1.

$$2Mg(OH)_2+SiO_2 \rightarrow Mg_2SiO_4+2H_2O \quad \text{[Reaction Scheme 1]}$$

That is, the electrical steel sheet subjected to the first recrystallization annealing is subjected to the second recrystallization annealing after applying a magnesium oxide slurry as an annealing separator, that is, it is subjected to high temperature annealing, and at this time, the material expanded by heat tries to shrink again upon cooling but the forsterite layer which is already formed on the surface disturbs shrinkage of the material. Residual stress □σRD in the rolling direction when the thermal expansion coefficient of the forsterite coating is very small compared to the material may be expressed by the following formulas.

$$\sigma_{RD}=2E_c\delta(\alpha_{Si-Fe}\alpha_c)\Delta T(1-\nu_{RD})$$

Herein,

ΔT=difference between the second recrystallization annealing temperature and room temperature (□), $\alpha_{Si-Fe}$=thermal expansion coefficient of the material, $\alpha_c$=thermal expansion coefficient of the primary coating, $E_c$=average value of the primary coating elasticity (Young's Modulus), δ=thickness ratio of the material and coating layer, and $\nu_{RD}$=Poisson's ratio in the rolling direction.

From the above formulas, the tensile strength improvement coefficient by first coating is the thickness of the first coating or the difference of thermal expansion coefficient between the substrate and the coating, and if the thickness of the coating is improved, the space factor becomes poor, and the tensile strength may be increased by widening the thermal expansion coefficient difference between the substrate and the coating. However, since the annealing separator is limited to magnesium oxide, there is a limitation in improving the coating tension by widening the thermal expansion coefficient difference or increasing the first coating elasticity (Young's Modulus) value.

In the exemplary embodiment of the present invention, an Al—Si—Mg composite is induced by introducing an aluminum-based additive which is capable of reacting with the silica which is present on the surface of the material to overcome the physical limitations of pure forsterite while the thermal expansion coefficient is lowered, and at the same time a part of it induces improvement of adhesion by diffusing into the oxide layer and presenting at the interface between the oxide layer and the substrate.

As mentioned above, the existing primary coating is forsterite formed by the reaction of Mg—Si, the thermal expansion coefficient is about $11\times10^{-6}$/K, and the difference from the base material does not exceed more than about 2.0. On the other hand, an Al—Si composite phase with a low thermal expansion coefficient includes mullite, and a Al—Si—Mg composite phase includes cordierite. The difference in thermal expansion coefficient between each composite phase and the material is about 7.0 to 11.0, while the Young's Modulus is slightly lower than that of conventional forsterite.

In the exemplary embodiment of the present invention, as mentioned above, some of the aluminum-based additives react with the silica present on the surface of the substrate, and some of the additives fuse into the oxide layer inside the substrate to improve the coating tension while being present in the form of aluminum oxide.

Hereinafter, the annealing separator composition according to an embodiment of the present invention will be described in detail for each component.

In the exemplary embodiment of the present invention, the annealing separator composition includes 100 weight parts of at least one of a magnesium oxide and a magnesium hydroxide. In the exemplary embodiment of the present invention, the annealing separator composition may be present in the form of a slurry to easily apply it to the surface of the substrate of the oriented electrical steel sheet. When the slurry contains water as a solvent, the magnesium oxide may be easily soluble in water, and may be present in the form of a magnesium hydroxide. Accordingly, in the exemplary embodiment of the present invention, the magnesium oxide and the magnesium hydroxide are treated as one component. The meaning of containing 100 weight parts of at least one of the magnesium oxide and the magnesium hydroxide refers to when the magnesium oxide alone is contained, i.e., 100 weight parts of magnesium oxide is contained, and when the magnesium hydroxide alone is contained, 100 weight parts of magnesium hydroxide is contained, and when the magnesium oxide and the magnesium hydroxide are contained at the same time, this indicates that a total amount thereof is 100 weight parts.

An activation degree of the magnesium oxide may be in a range of 400 to 3000 s. When the activation degree of the magnesium oxide is too large, a problem of leaving a spinel oxide ($MgO.Al_2O_3$) on the surface after second recrystallization annealing may arise. When the activation degree of the magnesium oxide is too small, it may not react with the oxide layer and form a coating. Therefore, the activation degree of the magnesium oxide may be controlled within the range mentioned above. In this case, the activation degree indicates the ability of MgO powder to cause a chemical reaction with other components. The activation degree is measured by a time that it takes MgO to completely neutralize a certain amount of a citric acid solution When the activation degree is high, the time required for the neutralization is short, while when the activation degree is low, the activation may be high. Specifically, it is measured as the time taken for the solution to change from white to pink when 2 g of MgO is placed to 100 ml of a 0.4 N citric acid solution to which 2 ml of a 1% phenolphthalein reagent is added at 30 ° C. and then stirred.

In the exemplary embodiment of the present invention, the annealing separator composition contains 5 to 200 weight parts of the aluminum hydroxide. In the exemplary embodiment of the present invention, aluminum hydroxide ($Al(OH)_3$) having a reactive hydroxy group (—OH) in an aluminum component system is introduced into the annealing separator composition. In the case of aluminum hydroxide, it is applied in the form of a slurry since the atomic size is small compared to magnesium oxide, and in the second recrystallization annealing, it diffuses to the oxide layer presenting on the surface of the material competitively with the magnesium oxide. In this case, a part of it will react with silica constituting a substantial part of the oxide of the surface of the material during the diffusion process and form a composite material of an Al—Si form by condensation reaction, and a part of it also reacts with oxides and form Mg—Si—Mg composite material.

Further, a part of the aluminum hydroxide permeates to the interface between the substrate and the oxide layer and is present in the form of aluminum oxide. Such aluminum oxide ($Al_2O_3$) may specifically be a-aluminum oxide. The amorphous aluminum hydroxide is subjected to phase inversion from a y phase to a a phase mostly at about 1100° C.

Therefore, in the exemplary embodiment of the present invention, reactive aluminum hydroxide ($Al(OH)_3$) is introduced into an annealing separator constituted of a magnesium oxide/magnesium hydroxide as main components, and a part forms an Al—Si—Mg ternary composite with a magnesium oxide/magnesium hydroxide to lower the coefficient of thermal expansion compared to conventional Mg—Si binary forsterite coatings, and at the same time, a part penetrates into the material and oxide layer interface to exist in the form of aluminum oxide while enhancing the coating elasticity and the interfacial adhesion between the substrate and the coating to maximize tension induced by the coatings.

Unlike the magnesium oxide and the magnesium hydroxide described above, in the case of aluminum hydroxide, it is hardly soluble in water and is not transformed into aluminum oxide ($Al_2O_3$) under conventional conditions. In the case of aluminum oxide ($Al_2O_3$), there is a problem that it is chemically very stable and most of it settles in the slurry, which makes it difficult to form a homogeneous phase, and there is a difficulty in forming an Al—Mg composite or an Al—Si—Mg composite since there is no chemically activated site. On the other hand, the aluminum hydroxide has excellent mixability in the slurry and has a chemical active phrase (—OH), which makes it easy to form an Al—Mg composite or Al—Si—Mg composite by reacting with silicon oxide or magnesium oxide/magnesium hydroxide.

The aluminum hydroxide is included at 5 to 200 weight parts with respect to 100 weight parts of at least one of magnesium oxide and magnesium hydroxide. When the aluminum hydroxide is contained in a too small amount, it is difficult to obtain the above mentioned effect of adding the aluminum hydroxide. When too much aluminum hydroxide is contained, the coating property of the annealing separator composition may deteriorate. Therefore, the aluminum hydroxide may be contained in the range mentioned above. More specifically, 10 to 100 weight parts of aluminum hydroxide may be contained. More specifically, 20 to 50 weight parts of aluminum hydroxide may be contained.

The aluminum hydroxide may have an average particle size of 5 to 100 μm. When the average particle size is too small, diffusion is mainly caused, and it may be difficult to form a composite in the form of a three-phase system such as Al—Si—Mg by the reaction. When the average particle size is too large, diffusion to the substrate is difficult, so that the effect of improving the coating tension may be significantly deteriorated.

The annealing separator composition for the oriented electrical steel sheet may further contain 1 to 10 weight parts of ceramic powder per 100 weight parts of at least one of the magnesium oxide and the magnesium hydroxide. The ceramic powder may be at least one selected from $Al_2O_3$, $SiO_2$, $TiO_2$, and $ZrO_2$. When the ceramic powder is further contained in an appropriate amount, the insulation properties of the coating may be further improved. Specifically, $TiO_2$ may be further contained as the ceramic powder.

The annealing separator composition may further contain a solvent for uniform dispersion and easy application of solids. Water, alcohol, etc. may be used as a solvent, and it may contain 50 to 500 weight parts with respect to 100 weight parts of at least one of the magnesium oxide and the magnesium hydroxide. As such, the annealing separator composition may be in the form of a slurry.

In the oriented electrical steel sheet 100 according to the exemplary embodiment of the present invention, a coating 20 including an Al—Si—Mg composite and an Al—B compound is formed on one or both sides of a substrate 10 of the oriented electrical steel sheet. FIG. 1 illustrates a schematic side cross-sectional view of an oriented electrical steel sheet according to an exemplary embodiment of the present invention. FIG. 1 illustrates a case where the coating 20 is formed on an upper surface of the substrate 10 of the oriented electrical steel sheet.

As described above, in the coating 20 according to the exemplary embodiment of the present invention, an appropriate amount of magnesium oxide/magnesium hydroxide and aluminum hydroxide are added in the annealing separator composition so that it contains an Al—Si—Mg composite and an Al—B compound The thermal expansion coefficient is lowered and the coating tension is improved, compared to the case where only the conventional forsterite is contained, by containing the Al—Si—Mg composite and the Al—B compound. This has been described above, and thus redundant description is omitted.

The coating 20 may further include an Mg—Si composite, an Al—Mg composite, or an Al—Si composite in addition to the Al—Si—Mg composite and Al—B compound described above.

An element composition of the coating 20 may contain 0.1 to 40 wt % of Al, 40 to 85 wt % of Mg, 0.1 to 40 wt % of Si, 10 to 55 wt % of O, and Fe as a balance. The above-mentioned element composition of Al, Mg, Si, Fe, and B are derived from components in the substrate and components of the annealing separator. In the case of O, it may be penetrated during a heat treatment process It may further contain additional impurities such as carbon (C)

The coating 20 may have a thickness of 0.1 to 10 μm. When the thickness of the coating 20 is too small, the capacity of imparting the coating tension may be lowered, which may cause a problem of inferior iron loss. When the thickness of the coating 20 is too large, the adhesion of the coating 20 becomes inferior, and peeling may occur. Accordingly, the thickness of the coating 20 may be adjusted to the above range. More specifically, the thickness of the coating film 20 may be 0.8 to 6 μm.

As illustrated in FIG. 1, an oxide layer 11 may be formed from the interface of the coating 20 and the substrate 10 to the inside of the substrate 10. The oxide layer 11 is a layer containing 0.01 to 0.2 wt % of O, which is distinguished from the remaining substrate 10 containing less O.

As described above, in the exemplary embodiment of the present invention, aluminum is diffused into the oxide layer 11 so that it forms an aluminum oxide in the oxide layer 11 by adding an aluminum hydroxide compound into the annealing separator composition. The aluminum oxide improves the adhesion between the oxide layer 11 and the coating 20 such that it improves the tension by the coating 20. Since the oxidation aluminum in the oxidation layer 11 has already been described above, redundant description will be omitted.

An average particle diameter of the aluminum oxide may be 5 to 100 μm with respect to a cross-section in a thickness direction of the steel sheet In addition, an occupying area of the aluminum oxide relative to an area of the oxide layer may be 0.1 to 50%, with respect to the cross-section in the thickness direction of the steel sheet. This fine distribution of aluminum oxide in the oxide layer 11 improves the adhesion between the oxide layer 11 and the coating 20, thereby improving the tensile force by the coating 20.

In the exemplary embodiment of the present invention, an effect of the annealing separator composition and coating 20 is exhibited regardless of the components of the substrate 10 of the oriented electrical steel sheet. The components of the substrate 10 of the oriented electrical steel sheet will be described as follows.

The substrate of the oriented electrical steel sheet may contain 2.0 to 7.0 wt % of silicon (Si), 0.020 to 0.040 wt % of aluminum (Al), 0.01 to 0.20 wt % of manganese (Mn), 0.01 to 0.15 wt % of phosphorus (P), 0.01 wt % or less (excluding 0 wt %) of carbon (C), 0.005 to 0.05 wt % of nitrogen (N), and 0.01 to 0.15 wt % of antimony (Sb), tin (Sn), or a combination thereof, and the balance contains Fe and other inevitable impurities. The description of each component of the substrate 10 of the oriented electrical steel sheet is the same as that generally known, so a detailed description thereof will be omitted.

According to an exemplary embodiment of the present invention, a manufacturing method of an oriented electrical steel sheet, includes: preparing a steel slab; heating the steel slab; forming a hot-rolled sheet by hot-rolling the heated steel slab; forming a cold-rolled sheet by cold-rolling the hot-rolled sheet; performing first recrystallization annealing on the cold-rolled sheet; applying an annealing separator on a surface of the steel sheet that has been subjected to the first recrystallization annealing; and performing second recrystallization annealing on the steel sheet on which the annealing separator is applied. In addition, the method for manufacturing the oriented electrical steel sheet may further include other steps.

First, a steel slab is prepared in step S10.

Next, the steel slab is heated. In this case, the slab heating may be performed by a low-temperature slab method at 1200 ° C. or less.

Next, a hot-rolled steel sheet is formed by hot-rolling the heated steel slab

Thereafter, the formed hot-rolled sheet may be subjected to hot-rolled sheet annealing.

Next, a cold-rolled sheet is formed by cold-rolling the hot-rolled sheet. The forming of the cold-rolled sheet may be performed by cold rolling once or by cold rolling two or more times including intermediate annealing.

Next, the cold-rolled sheet is subjected to first recrystallization annealing. The performing of the first recrystallization annealing may include simultaneously performing decarburizing annealing and nitriding annealing on the cold-rolled sheet or performing the nitriding annealing after the decarburizing annealing.

Next, an annealing separator is applied onto a surface of the steel sheet that has been subjected to the first recrystallization annealing. Since the annealing separator has been described above in detail, repeated description will be omitted.

An application amount of the annealing separator may be in a range of 6 to 20 g/m$^2$. When the application amount of the annealing separator is too small, the coating formation may not be smoothly performed. When the application amount of the annealing separator is too large, it may affect the second recrystallization. Accordingly, the application amount of the annealing separator may be adjusted to the above range.

It may further include drying after applying the annealing separator. Specifically, a drying temperature may be in a range of 300 to 700 ° C. When the temperature is too low, the annealing separator may not be easily dried. When the temperature is too low, it may affect the second recrystallization. Accordingly, the drying temperature of the annealing separator may be adjusted to the above range.

Next, second recrystallization annealing is performed on the steel sheet on which the annealing separator is applied. The coating 20 including forsterite of Mg—Si, a composite of Al—Si, Al—Mg, and Al—B compounds as shown in Formula 1 is formed on an outermost surface by the annealing separator component and the silica reaction during the second recrystallization annealing. Further, oxygen and aluminum penetrate into the substrate 10 to form the oxidation layer 11.

The second recrystallization annealing may be carried out at a heating rate of 18 to 75 ° C./h in a temperature range of 700 to 950 ° C., and at a heating rate of 10 to 15 ° C./h in a temperature range of 950 to 1200 ° C. The coating 20 may be smoothly formed by controlling the heating rate in the ranges mentioned above. Further, the temperature rise process at 700 to 1200 ° C. may be carried out in an atmosphere including 20 to 30 vol % of nitrogen and 70 to 80 vol % of hydrogen, and after reaching 1200 ° C., in an atmosphere including 100 vol % of hydrogen. The coating 20 may be smoothly formed by controlling the atmosphere in the ranges mentioned above.

Hereinafter, the present invention will be described in more detail through examples. However, the examples are only for illustrating the present invention, and the present invention is not limited thereto.

EXAMPLES

A steel slab containing 3.2 wt % of Si, 0.055 wt % of C, 0.12 wt % of Mn, 0.026 wt % of Al, 0.0042 wt % of N, 0.04 wt % of Sn, 0.03 wt % of Sb, and 0.03 wt % of P, and a balance including Fe and other inevitable impurities, was prepared.

The slab was heated at 1150 ° C. for 220 min and then hot-rolled to a thickness of 2.8 mm to form a hot-rolled sheet.

The hot-rolled sheet was heated to 1120 ° C., maintained at 920 ° C. for 95 s, and then quenched in water and pickled, followed by cold rolling to a thickness of 0.23 mm to form a cold-rolled sheet.

The cold rolled sheet was placed in a furnace which is maintained at 875 ° C., and then maintained for 180 s in a mixed atmosphere of 74 vol % of hydrogen, 25 vol % of nitrogen, and 1 vol % of dry ammonia gas, and was simultaneously subjected to decarburization and nitriding treatments.

As the annealing separator composition, an annealing separator was prepared by mixing 100 g of magnesium oxide having an activity for 500 seconds, a solid phase mixture including aluminum hydroxide and boron trioxide in an amount listed in Table 1, and 5 g of titanium oxide, and 400 g of water. 10 g/m$^2$ of the annealing separator was applied and second recrystallization annealing was performed in a type of a coil. A first soaking temperature and a second soaking temperature were set to 700 ° C. and 1200 ° C., respectively, in the second recrystallization annealing, and in the heating section, the heating condition was set to 45 ° C./h in a temperature section of 700 ° C. to 950 ° C. and 15 ° C./h in a temperature section of 950 ° C. to 1200 ° C. Meanwhile, the soaking was performed in which the soaking time was set to 15 hours at 1200 ° C. The secondary recrystallization annealing was performed in a mixed atmosphere of 25 vol % nitrogen and 75 vol % hydrogen up to 1200 ° C., and after reaching 1200 ° C., the sheet was maintained in an atmosphere of 100 vol % hydrogen, and then the sheet was cooled in the furnace.

Table 1 summarizes components of the annealing separator applied to the present invention. Table 2 summarizes tension, adhesion, iron loss, magnetic flux density, and rate of iron loss improvement after the annealing separator prepared as shown in Table 1 was applied to the specimen and subjected to second recrystallization annealing.

In addition, the coating tension is obtained by measuring a radius of curvature (H) of a specimen generated after removing the coating on one side of the specimen coated on opposite sides, and then substituting the value into the following equation.

$$\delta_{Exp} = \frac{E_c}{1 - v_{RD}} \times \frac{T^2}{3t} \times \frac{2H}{l^2}$$

$E_c$: Young's Modulus of a coating layer
$u_{RD}$: Poisson's ratio in the rolling direction
T: Thickness before coating
t: Thickness after coating
l: Length of specimen
H: Radius of curvature Further, the adhesion is represented by a minimum arc diameter without peeling of the coating when the specimen is bent by 180° in contact with an arc of 10 to 100 mm.

The iron loss and magnetic flux density were measured by a single sheet measurement method, wherein the iron loss (W17/50) indicates a power loss represented when magnetizing a magnetic field of a frequency of 50 Hz to 1.7 Tesla by AC. The magnetic flux density ($B_8$) indicates a flux density value flowing in an electrical steel sheet when a current of 800 Nm was flowed through a winding wound around an electrical steel sheet.

The iron loss improvement was calculated on the basis of the comparative example using a MgO annealing separator ((iron loss of comparative example—iron loss of example)/iron loss of comparative example)×100.

TABLE 1

| Specimen No. | Magnesium oxide (g) | Aluminum hydroxide (g) | Aluminum hydroxide (μm) | Titanium oxide (g) | Pure water (g) | Remarks |
|---|---|---|---|---|---|---|
| 1 | 100 | 20 | 0.5 | 25 | 1250 | Example 1 |
| 2 | 100 | 100 | 0.5 | 25 | 1250 | Example 2 |
| 3 | 100 | 20 | 3 | 25 | 1250 | Example 3 |
| 4 | 100 | 100 | 3 | 25 | 1250 | Example 4 |
| 5 | 100 | 20 | 10 | 25 | 1250 | Example 5 |
| 6 | 100 | 100 | 10 | 25 | 1250 | Example 6 |
| 7 | 100 | 20 | 50 | 25 | 1250 | Example 7 |
| 8 | 100 | 100 | 50 | 25 | 1250 | Example 8 |
| 9 | 100 | 20 | 80 | 25 | 1250 | Example 9 |
| 10 | 100 | 100 | 80 | 25 | 1250 | Example 10 |
| 11 | 100 | 20 | 100 | 25 | 1250 | Example 11 |
| 12 | 100 | 100 | 100 | 25 | 1250 | Example 12 |
| 13 | 100 | 20 | 200 | 25 | 1250 | Example 13 |
| 14 | 100 | 100 | 200 | 25 | 1250 | Example 14 |
| 15 | 100 | — | — | 5 | 250 | Comparative Examples |

TABLE 2

| Specimen No. | Coating tension (kgf/mm$^2$) | Adhesiveness ($mm_\phi$) | Magnetic properties: Iron loss | Magnetic properties: Improvement (%) | Magnetic properties: Magnetic flux density ($B_8$) | Remarks |
|---|---|---|---|---|---|---|
| 1 | 0.45 | 25 | 0.94 | 1.1 | 1.91 | Example 1 |
| 2 | 0.43 | 25 | 0.95 | 0.0 | 1.91 | Example 2 |
| 3 | 0.46 | 25 | 0.93 | 2.1 | 1.91 | Example 3 |
| 4 | 0.44 | 25 | 0.95 | 0.0 | 1.91 | Example 4 |
| 5 | 0.85 | 20 | 0.91 | 4.2 | 1.92 | Example 5 |
| 6 | 0.90 | 20 | 0.89 | 6.3 | 1.93 | Example 6 |
| 7 | 0.95 | 20 | 0.87 | 8.4 | 1.93 | Example 7 |
| 8 | 0.93 | 20 | 0.88 | 7.4 | 1.93 | Example 8 |
| 9 | 1.05 | 15 | 0.83 | 11.7 | 1.94 | Example 9 |
| 10 | 0.98 | 15 | 0.86 | 9.5 | 1.94 | Example 10 |
| 11 | 0.88 | 20 | 0.90 | 5.3 | 1.93 | Example 11 |
| 12 | 0.91 | 20 | 0.89 | 6.3 | 1.93 | Example 12 |
| 13 | 0.50 | 25 | 0.94 | 1.1 | 1.92 | Example 13 |
| 14 | 0.52 | 25 | 0.94 | 1.1 | 1.92 | Example 14 |
| 15 | 0.40 | 25 | 0.95 | — | 1.90 | Comparative Examples |

As shown in Table 1 and Table 2, it can be seen that when aluminum hydroxide and boron trioxide were added to the annealing separator, the coating tension was improved and the magnetic properties were ultimately improved as compared with the case without addition of aluminum hydroxide and boron trioxide.

FIG. 2A to FIG. 2E illustrate results of focused ion beam-scanning electron microscopy (FIB-SEM) analysis of the coating of the oriented electrical steel sheet manufactured in Example 5.

Figure 2A:
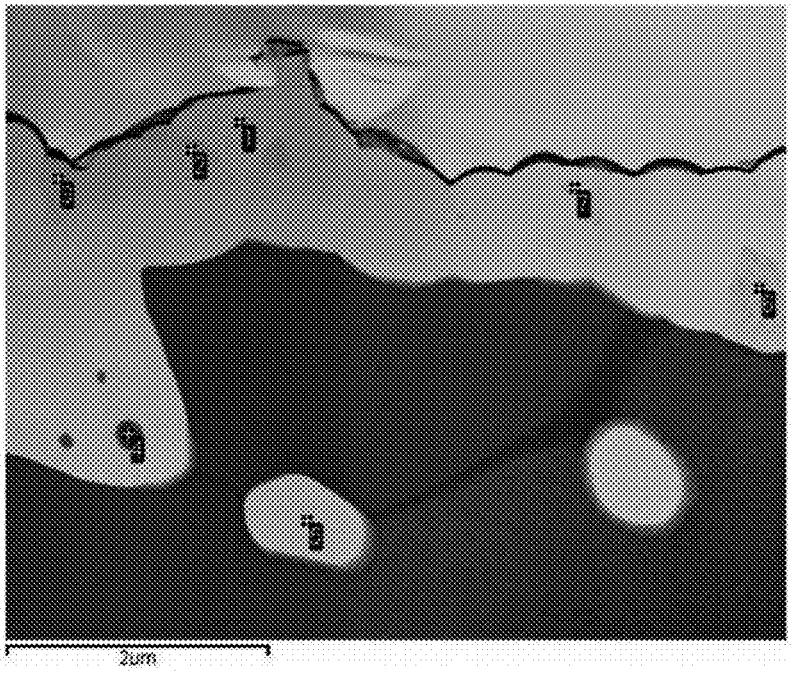
FIG. 2A to FIG. 2E illustrate results of focused ion beam-scanning electron microscope (FIB-SEM) analysis of a coating of an oriented electrical steel sheet manufactured in Example 5.
Figure 2B:
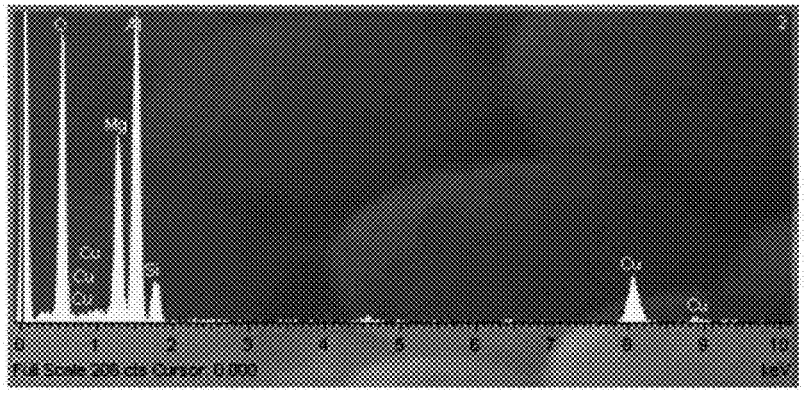
Figure 2C:
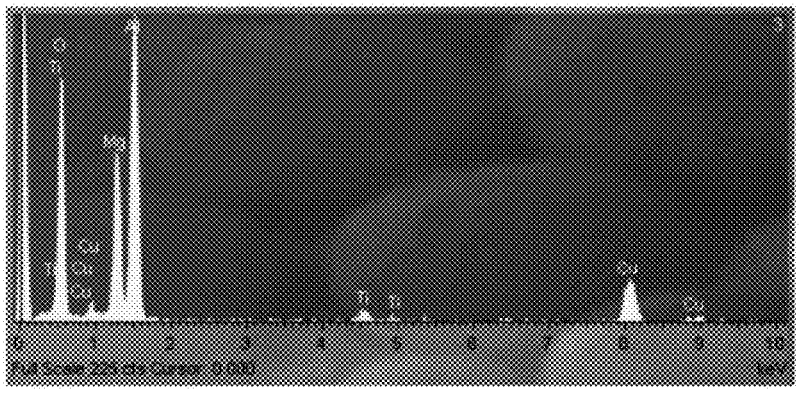
Figure 2D:
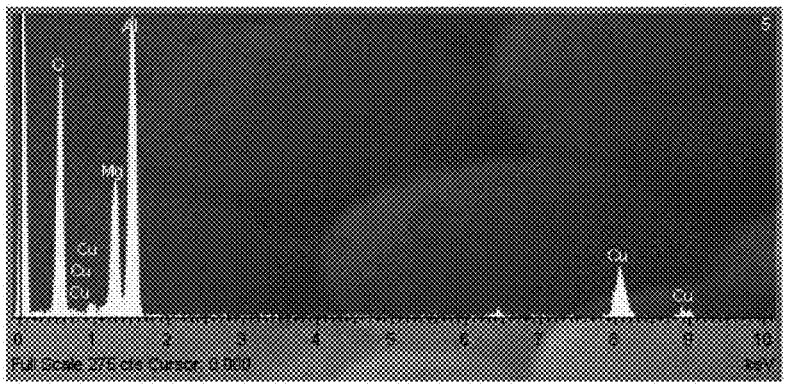
Figure 2E:
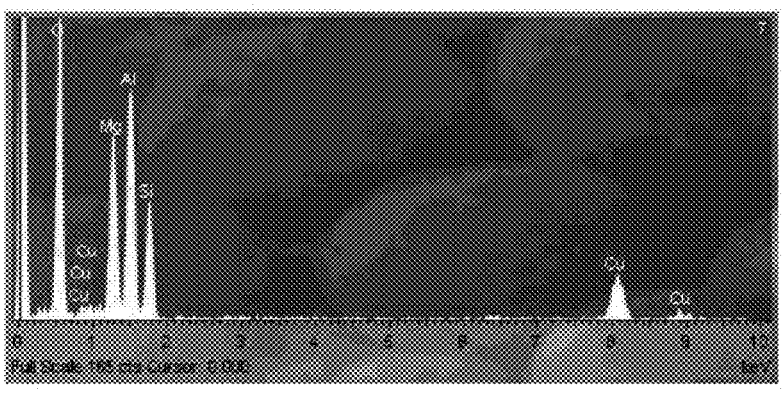

FIG. 2B, 2C, 2D, and 2E illustrate analysis results at positions 2, 3, 6, and 7 in FIG. 2A, respectively.

As shown in the FIGS., cross-sections which are seen as aluminum complexes are identified in the middle of the coating. As a result, it may be confirmed that aluminum hydroxide added in the annealing separator makes the Al—Si—Mg ternary composite material serve to lower the coefficient of thermal expansion along with the magnesium oxide, compared with that of the conventional forsterite coating, thereby ultimately improving the magnetic properties.

Figure 3:
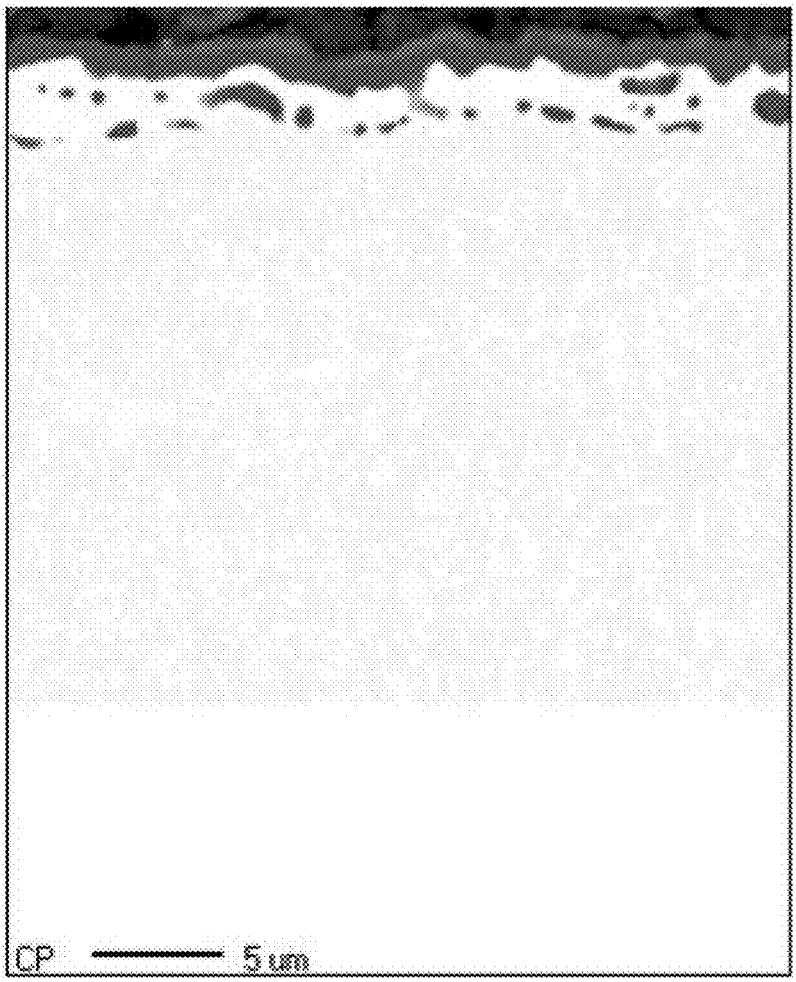
FIG. 3 illustrates a scanning electron microscope (SEM) photograph of the cross-section of the oriented electrical steel sheet manufactured in Example 5.
Figure 4:
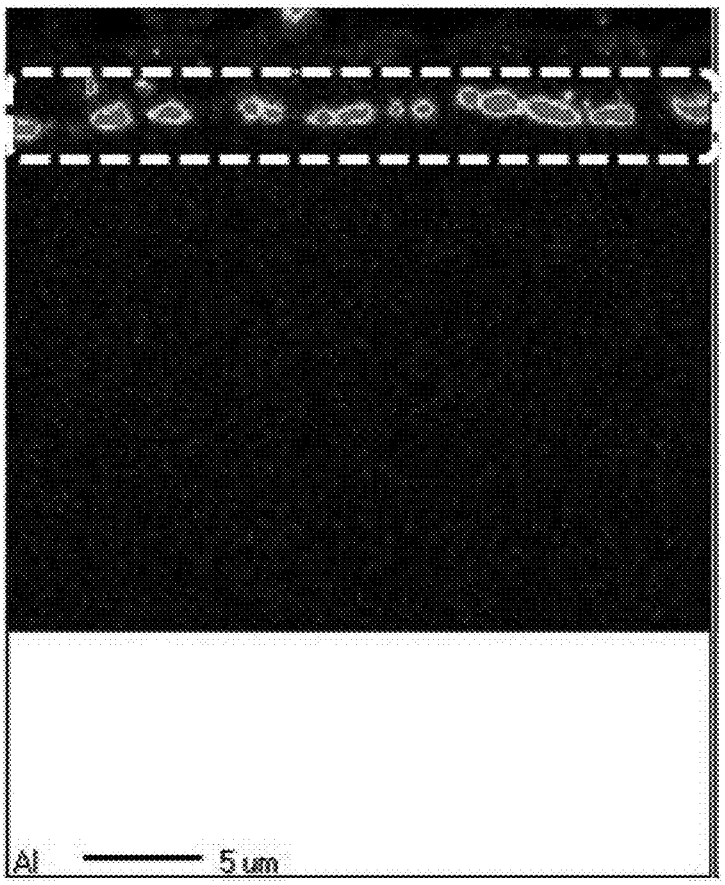
FIG. 4 illustrates a result of electron probe microanalysis (EPMA) of the cross-section of the oriented electrical steel sheet manufactured in Example 5.
Figure 5:
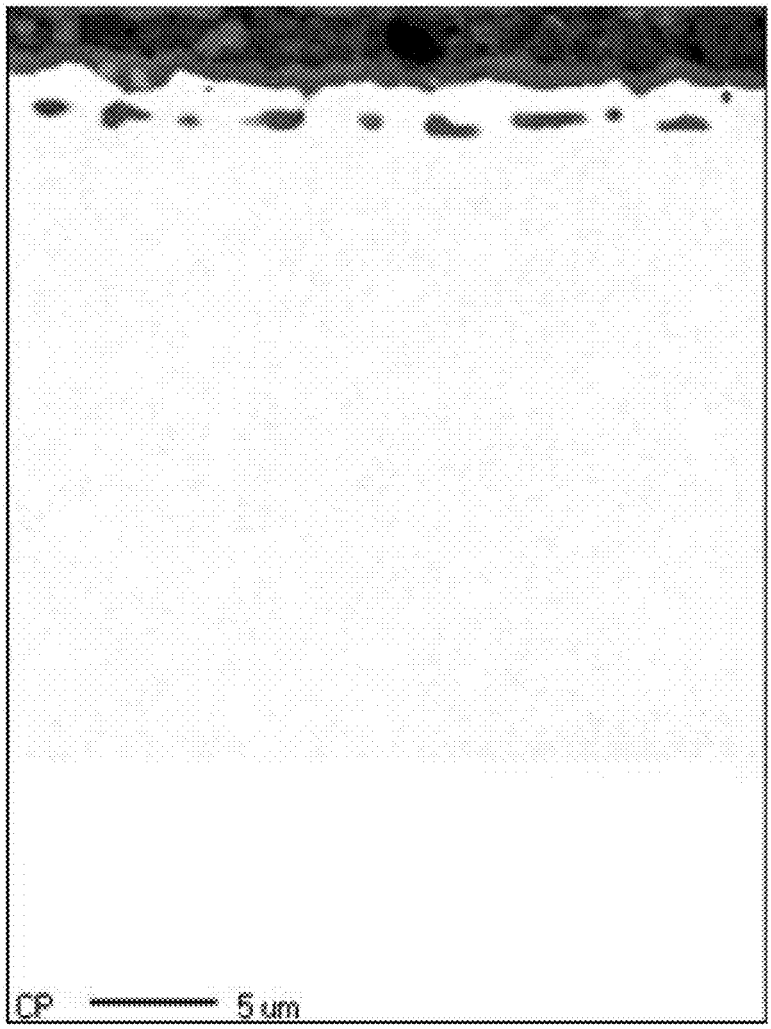
FIG. 5 illustrates a scanning electron microscope (SEM) photograph of the cross-section of the oriented electrical steel sheet manufactured in a comparative example.
Figure 6:
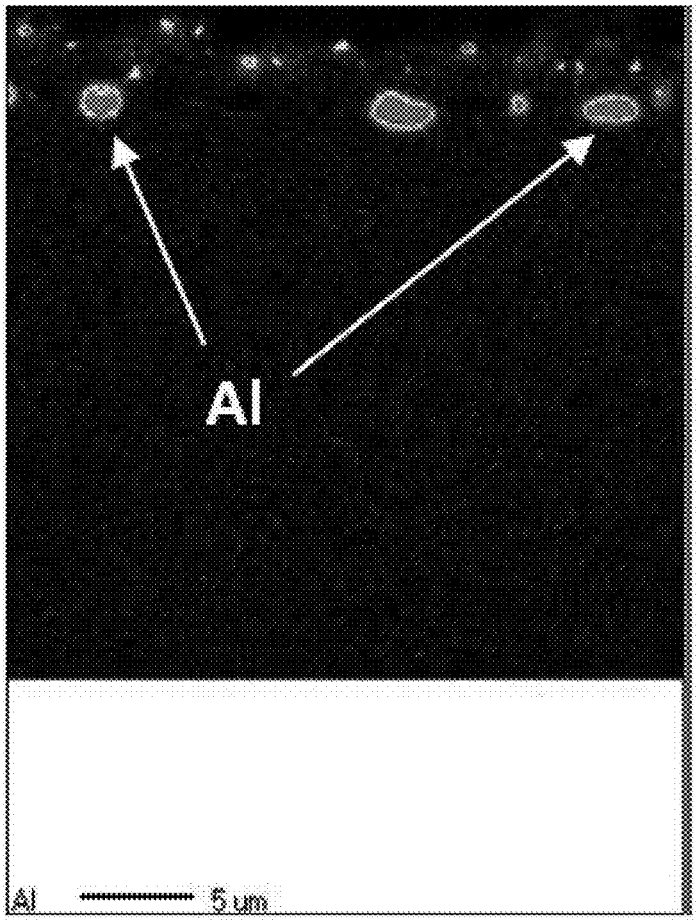
FIG. 6 illustrates a result of electron probe microanalysis (EPMA) of the cross-section of the oriented electrical steel sheet manufactured in a comparative example.

FIG. 3 and FIG. 4 illustrate scanning electron microscope (SEM) photographs and electron probe microanalysis (EPMA) analysis results of the cross-section of the oriented electrical steel sheet manufactured in Example 5. FIG. 5 and FIG. 6 illustrate scanning electron microscope (SEM) photographs and electron probe microanalysis (EPMA) results of the cross-section of the oriented electrical steel sheet manufactured in the comparative example.

As shown in FIG. 3 and FIG. 4, it may be confirmed that when aluminum hydroxide is added, aluminum atoms are distributed in a large amount in the oxide layer (layer between white dotted lines) in the form of aluminum oxide and aluminum boron oxide. It may be understood that aluminum hydroxide and aluminum boron oxide added in the annealing separator are formed by penetrating into the substrate. In Example 5, it may be confirmed that the average particle sizes of aluminum oxide and aluminum boron oxide were 50 μm and 10 μm, respectively, and the area fraction was 5%. On the other hand, as shown in FIG. 5 and FIG. 6, it may be confirmed that aluminum oxide is partially present even when aluminum hydroxide is not added to the annealing separator. It may be confirmed that this is derived from aluminum included in the substrate itself, and a relatively small amount of aluminum atoms are distributed.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described exemplary embodiments are for illustrative purposes only, and the scope of the present invention is not limited thereto.

DESCRIPTION OF SYMBOLS

100: oriented electrical steel sheet
10: substrate of oriented electrical steel plate
11: oxide layer
20: coating

The invention claimed is:

1. An oriented electrical steel sheet comprising a coating including an Al-Si-Mg composite formed on one or opposite sides of a substrate of an oriented electrical steel sheet, wherein an oxide layer is formed from an interface between the coating and the substrate to an interior of the substrate, wherein the oxide layer contains an aluminum oxide, wherein an average particle diameter of the aluminum oxide is 5 to 100 μm with respect to a cross-section in a thickness direction of the steel sheet, and wherein an occupying area of the aluminum oxide relative to an area of the oxide layer is 0.1 to 50% with respect to the cross-section in the thickness direction of the steel sheet.

2. An oriented electrical steel sheet of claim 1, wherein the coating contains 0.1 to 40 wt % of Al, 40 to 85 wt % of Mg, 0.1 to 40 wt % of Si, 10 to 55 wt % of O, and Fe as a balance.

3. The oriented electrical steel sheet of claim 1, wherein the coating further includes an Mg—Si composite, an Al—Mg composite, or an Al—Si composite.

4. The oriented electrical steel sheet of claim 1, wherein the coating has a thickness of 0.1 to 10 μm.

5. The oriented electrical steel sheet of claim 1, wherein the substrate of the oriented electrical steel sheet contains 2.0 to 7.0 wt % of silicon (Si), 0.020 to 0.040 wt % of aluminum (Al), 0.01 to 0.20 wt % of manganese (Mn), 0.01 to 0.15 wt % of phosphorus (P), 0.01 wt % or less (excluding 0 wt %) of carbon (C), 0.005 to 0.05 wt % of nitrogen (N), and 0.01 to 0.15 wt % of antimony (Sb), tin (Sn), or a combination thereof, and the balance contains Fe and other inevitable impurities.

6. A method for manufacturing a grain-oriented electrical steel sheet of claim 1 comprising:

preparing a steel slab; heating the steel slab;

hot rolling the heated steel slab to produce a hot rolled sheet; cold rolling the hot rolled sheet to produce a cold rolled sheet; primary recrystallization annealing the cold rolled sheet;

applying an annealing separator to the surface of the primary recrystallization annealed steel sheet; and secondary recrystallization annealing the steel sheet applied with the annealing separator thereto, thereby producing the grain-oriented electrical steel of claim 1, wherein the annealing separator comprises 100 parts by weight of at least one of magnesium oxide and magnesium hydroxide; 5 to 200 parts by weight of aluminum hydroxide; and 0.1 to 20 parts by weight of a boron compound.

7. The manufacturing method of claim 6, wherein the performing of the first recrystallization annealing on the cold-rolled sheet includes simultaneously performing decarburizing annealing and nitriding annealing on the cold-rolled sheet or performing the nitriding annealing after the decarburizing annealing.

* * * * *